US006565761B1

(12) United States Patent
Kesper

(10) Patent No.: US 6,565,761 B1
(45) Date of Patent: May 20, 2003

(54) PROCESS AND DEVICE FOR PRODUCING A PRINTING TOOL

(75) Inventor: Peter Kesper, Krefeld (DE)

(73) Assignee: Kesper Druckwalzen GmbH, Krefeld (DE)

( * ) Notice: Subject to any disclaimer, the term of this patent is extended or adjusted under 35 U.S.C. 154(b) by 0 days.

(21) Appl. No.: 09/537,713

(22) Filed: Mar. 30, 2000

(30) Foreign Application Priority Data

Mar. 30, 1999 (DE) ..... 199 14 323

(51) Int. Cl.[7] ..... C25F 3/00

(52) U.S. Cl. ..... 216/11; 216/41; 216/42; 216/83; 101/401.1; 101/450.1; 427/334; 427/363; 427/416

(58) Field of Search ..... 216/11, 41, 42, 216/83, 96, 100, 103; 101/401.1, 450.1, 128.21, 129; 427/334, 363, 416

(56) References Cited

U.S. PATENT DOCUMENTS 3,635,194 A * 1/1972 Prior ..... 118/301
3,813,761 A * 6/1974 Foster ..... 257/126
3,841,261 A * 10/1974 Hudson et al. ..... 118/505
3,887,421 A * 6/1975 Hudson et al. ..... 101/129
4,292,104 A * 9/1981 Heimbach et al. ..... 156/235
4,640,191 A * 2/1987 Bradley ..... 101/470
4,767,489 A * 8/1988 Lindner ..... 156/345
5,458,590 A * 10/1995 Schleinz et al. ..... 604/361
5,495,803 A 3/1996 Gerber et al.
5,694,852 A * 12/1997 Bressler et al. ..... 101/401.1
5,794,859 A * 8/1998 Goenka et al. ..... 239/555
5,852,975 A 12/1998 Miyabe et al.

FOREIGN PATENT DOCUMENTS

EP 0 885 718 12/1998
EP 0 913 730 5/1999

* cited by examiner

*Primary Examiner*—Alexander Markoff
*Assistant Examiner*—Gentle Winter
(74) *Attorney, Agent, or Firm*—Nixon Peabody LLP; David S. Safran

(57) ABSTRACT

A process and a device for producing a printing tool in which a mask for sectional chemical passivation is applied to the surface of a workpiece that is to be subjected to a chemical surface working. In accordance with one embodiment, the process for producing a printing tool includes the steps of providing a workpiece having a surface which is subjected to a chemical surface working and spot spraying the surface of the workpiece section-by-section with a mask for sectional chemical passivation where the mask is essentially a wax and is sprayed onto the surface of the workpiece by a plurality of nozzles that are controlled with EDP support.

8 Claims, 3 Drawing Sheets

PROCESS AND DEVICE FOR PRODUCING A PRINTING TOOL

BACKGROUND OF THE INVENTION

1. Field of the Invention

The invention relates to a process and a device for producing a printing tool. In particular, the invention relates to a process for applying a mask for sectional chemical passivation to a surface of a workpiece and to such a workpiece which has been provided with such a mask.

2. Description of Related Art

Various processes and corresponding devices are known in the prior art for producing various types of printing tools. For example, etched rotogravure forms or relief printing forms, and galvanically produced screen printing forms are known in the prior art. In the known processes for producing a printing tool, the workpiece, which in the case of a rotogravure form (for example) is formed by an unworked rotogravure cylinder, is subjected to chemical surface working. In a rotogravure form, the workpiece is subjected to surface etching which is the chemical surface working. In this known processes for producing a printing tool where the surface of the workpiece to be etched, the areas of the printing form which are not to be subjected to this surface working are covered by a mask. This mask chemically passivates the surface sections of the workpiece which are not to be worked, i.e. the covered areas of the surface are not reached by chemical surface working.

In the known processes for producing a printing tool the masks which are necessary for sectional chemical passivation of the workpieces to be worked, a photosensitive layer is applied to the surface of the workpiece, this photosensitive layer being exposed with a negative or positive of the sections of the mask to be covered or to be kept exposed and then the photosensitive layer being developed. After this development, either the exposed or unexposed areas of the photosensitive areas are flushed by washing the workpiece so that as a result the desired mask remains on the surface of the workpiece to be worked.

This process which is known from the prior art is problematic in two important respects. On the one hand, the process of applying, exposing, developing and flushing the photosensitive layer is time-consuming and labor-intensive and on the other hand, the reproducibility of the masks produced in this way is not sufficient for various purposes. It is especially problematic in reproducibility because the negative or positive for exposure of the photosensitive layer must always be attached exactly in the same position relative to the photosensitive layer. This is no longer a given in the case where the negative or positive for exposure of the photosensitive layer is placed directly on the latter when the negative or positive at each location of the photosensitive layer does not have the same distance to the latter.

The reproducibility of application of the mask is of special importance particularly in relief printing which requires high imaging accuracy. In relief printing, for three-dimensional working of the paper, surface structures with relatively large and varied height differences are produced on the printing form. To do this, the printing form is etched repeatedly and is also covered repeatedly by a mask. With the known process for producing a printing form, the masks which are applied in succession cannot be positioned accurately enough relative to one another to guarantee the desired imaging accuracy.

Moreover, in the known processes, it is still problematic that flexibility is low in mask production. For each new mask, a new negative or positive must be produced for exposure of the photosensitive layer which in turn entails considerable cost.

SUMMARY OF THE INVENTION

In view of the foregoing, it is a primary object of the present invention to make available a process and a device for producing a printing tool which makes it possible to quickly, reproducibly and variably apply a mask for chemical passivation to the surface of a workpiece to be worked.

The pximary object above is achieved in accordance with the present invention in that the mask is produced from wax and the wax is sprayed section-by-section onto the workpiece from several nozzles in spots with EDP support, i.e., using an electronic data processor control. Therefore, in accordance with the present invention, the wax mask is applied in spots on the surface of the workpiece in a manner somewhat similar to known inkjet printers. With the process in accordance with the present invention, printing tools which may be in any shape including printing plates and printing cylinders, can be worked.

Since waxes are resistant to most acids and moreover, have low electrical conductivity and are at the same time water-repellant, they are suitable for chemical passivation of surfaces both in surface etching, as well as in galvanic surface coating. The EDP-supported spraying of wax onto the surface of the workpiece with the currently available drive engineering for the printing heads necessary for this purpose enables very high reproducibility in the production of the mask and maximum possible flexibility since any shape of the mask stored in the EDP system can be chosen and sprayed on via EDP-supported spraying. The present invention is also advantageous in that the mask can be applied to the surface of the workpiece to be worked in a single process.

A first advantageous embodiment of the process in accordance with the present invention is the use of an etching technique for the chemical surface working. As already mentioned, waxes are resistant to most of the acids used in surface working by etching. In this way, during etching, only the sections of the surface of the workpiece which are not covered by the wax are worked.

Because a printing form for rotogravure printing or relief printing is worked as the workpiece, and at the same time an etching technique is used, the printing forms for rotogravure or relief printing can be produced quickly, reproducibly and variably by the process in accordance with the present invention. In particular, by practicing the present invention in the production of printing forms for relief printing, it is guaranteed that even complex height profiles which are produced in several etching steps using different masks can be produced with the desired imaging accuracy.

If a mold for galvanic coating for producing a printing tool is worked as the workpiece, screen printing forms can be produced with the process in accordance with the present invention.

The process in accordance with the present invention is made especially advantageous by a special procedure for spraying wax onto the workpiece, in which the nozzles are arranged next to one another in the direction of the X-axis, the nozzles and the workpiece move in the direction of the Y-axis relative to one another, the nozzles are combined functionally into groups of at least one nozzle at a time, the nozzles and the workpiece are moved relative to one another in the direction of the X-axis after working of the tool in the direction of the Y-axis to a new position with reference to the X-axis, and the step width of the motion in the direction of the X-axis corresponds to the group width minus or plus the distance of adjacent nozzles divided by the number of groups. According to this embodiment of the process in accordance with the present invention, the wax layer is applied to the workpiece by the printing head, for example, during rotation of a cylindrical workpiece. In this regard, the printing head which has the nozzles is advanced after each revolution of the workpiece far enough so that the group bordering the group preceding applies the bordering wax points directly next to the wax points applied by the previous group during the previous revolution. This means that for each revolution of the workpiece, it is not the complete mask which is applied to the workpiece in the area of the nozzles, but only a fraction of the mask, while the next fractions are then applied by the following groups.

This embodiment of the process in accordance with the present invention differs, for example, from the known process for producing an inkjet print image. The advantage of the described embodiment is that the distance between the nozzles can be chosen to be much larger than required if the complete graphics would be applied with maximum resolution as the printing head moves past the workpiece.

This described embodiment of the process in accordance with the present invention is further improved by the fact that the group which is last in the direction towards the motion along the X-axis is formed from one nozzle less than the remaining groups. Because the last nozzle of the last group is eliminated, it is ensured that a wax point is not sprayed twice onto the surface of the workpiece to be worked. In this way the resolution of the wax layer applied to the workpiece is made uniform.

A device which is known from the prior art for producing a printing tool with a receiver for a workpiece and a means for applying a mask for sectional chemical passivation of the surface of the workpiece in accordance with the present invention, is developed especially for implementation of the above described process where the mask is essentially of wax. The means for applying the mask has EDP control and the means for applying a mask has at least one printing head with several nozzles for spot spraying of the wax onto the workpiece. This device in accordance with the present invention guarantees implementation of the advantages described with respect to the process as described previously.

There are now numerous possibilities for embodying and developing the process in accordance with the present invention and the device of the present invention for producing a printing tool. The object, features and advantages of the present invention will become more apparent from the following detailed description of the preferred embodiments of the invention when viewed in conjunction with the accompanying drawings.

DETAILED DESCRIPTION OF THE INVENTION

Figure 1A:
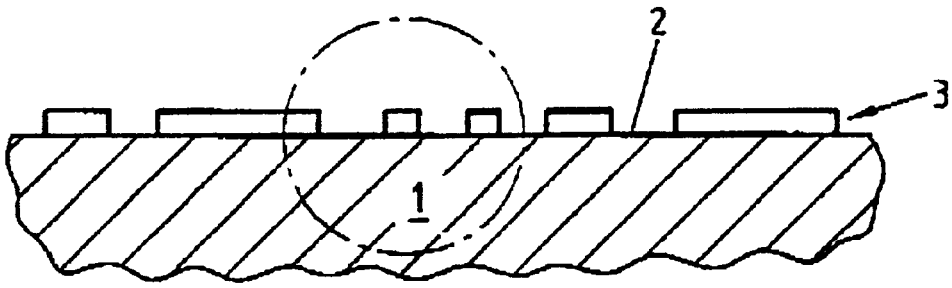
FIGS. 1*a* to 1*c* each show a partially enlarged section through the surface of a workpiece which is to be worked with the process in accordance with the present invention for producing a printing tool.

FIG. 1*a* shows a cutout view of a workpiece 1 with a surface 2 which is to be worked and a mask 3 which has been produced from wax and is located on the surface 2. The wax is sprayed section-by-section onto the workpiece 1 from several nozzles in spots with EDP support as described below in a manner somewhat similar to inkjet printers.

Figure 1B:
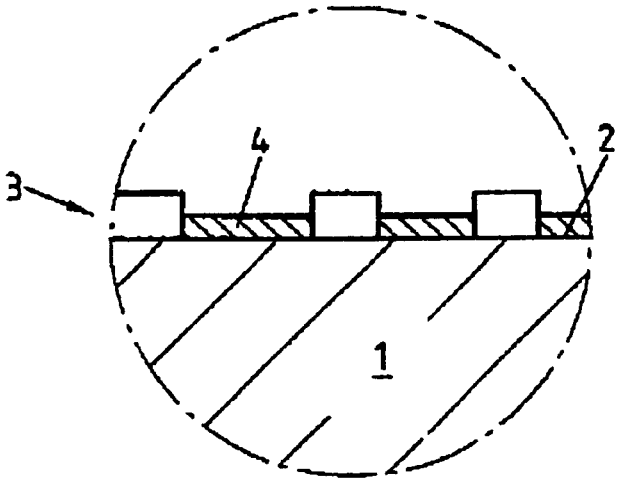
Figure 1C:
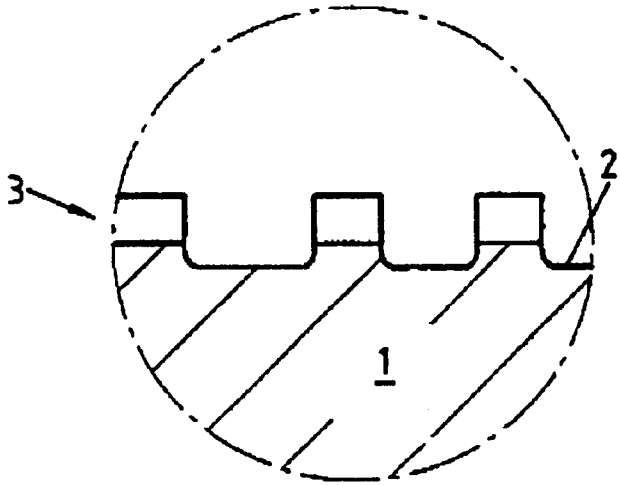

As can be easily seen in FIG. 1*a*, the mask 3 covers the surface 2 of the workpiece 1 only in sections. The exposed sections of the surface 2 of the workpiece 1 are galvanically coated after applying the mask 2, for example, as is shown in FIG. 1*b*. In this galvanic coating, a metal 4 is deposited on the uncovered sections of the surface 2. Alternatively, the surface 2 can also be worked by etching (as shown in FIG. 1*c*). In this etching working, the surface 2 is lowered in the sections which are not covered by the mask 3.

Since the wax which forms the mask 3 is resistant both to most acids, and also prevents the galvanic deposition of metal on the surface 2 of the workpiece 1, the process in accordance with the present invention in which a mask 3 of wax is deposited on the surface 2 of a workpiece 1 is suited both for surface working by etching, and also by galvanic deposition as described previously.

Figure 2:
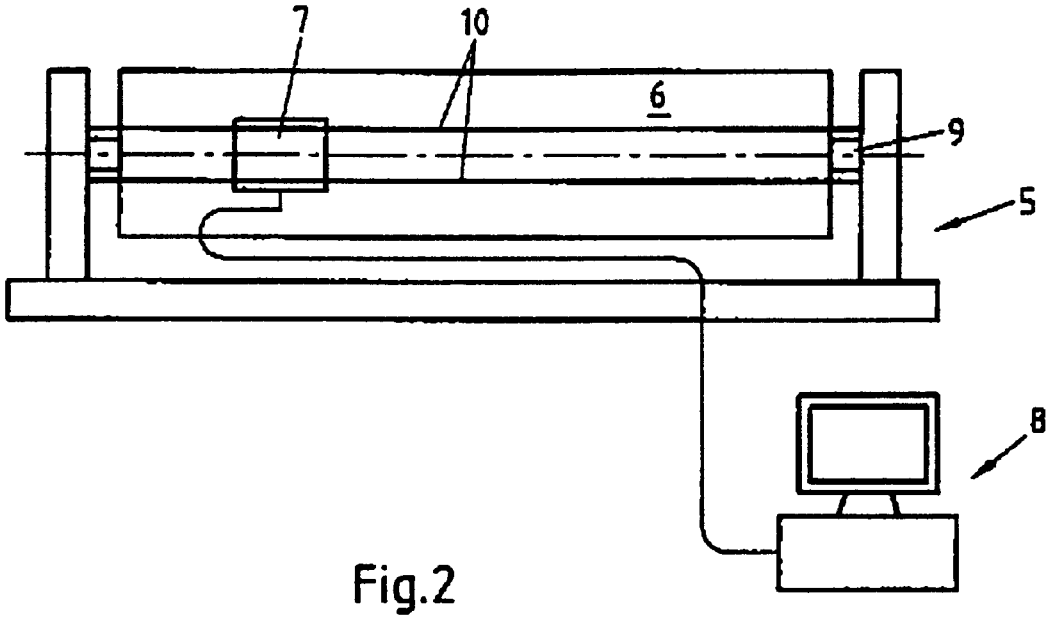
FIG. 2 shows one embodiment of a device in accordance with the present invention for producing a printing tool.

FIG. 2 shows an embodiment of a device for producing a printing tool with a receiver 5 for a rotogravure roller 6 and a printing head 7 for applying a mask (as shown in FIGS. 1*a*–1*c*) for sectional chemical passivation of the surface of the rotogravure roller 6. In accordance with the present invention, with the device shown, a wax mask is applied to the surface of the rotogravure roller 6. To control the printing head 7, the embodiment shown has a computer 8 which may be a conventional personal computer for example.

The rotogravure roller 6 is supported on the receiver 5 via a shaft 9. The printing head 7 is likewise supported on the receiver 5 via two guide rails 10. The computer 8 controls the rotation of the rotogravure roller 6, the movement of the printing head 7 and the triggering of the nozzles of the printing head 7 (not shown in FIG. 2) such that a wax mask is applied to the rotogravure roller 6 according to the graphic data present in the computer 8.

The EDP-supported spraying of wax onto the surface of the workpiece 1 with the currently available drive engineering for the printing heads 7 necessary for this purpose enables very high reproducibility in the production of the mask 3 and maximum possible flexibility since any shape of the mask stored in the EDP system can be chosen and sprayed on via EDP-supported spraying. The present invention is also advantageous in that the mask can be applied to the surface of the workpiece to be worked in a single process.

Because a printing form for rotogravure printing or relief printing is worked as the workpiece, and at the same time an etching technique is used, the printing forms for rotogravure or relief printing can be produced quickly, reproducibly and variably by the process in accordance with the present invention. In particular, by practicing the present invention in the production of printing forms for relief printing, it is guaranteed that even complex height profiles which are produced in several etching steps using different masks can be produced with the desired imaging accuracy.

If a mold for galvanic coating for producing a printing tool is worked as the workpiece, screen printing forms can be produced with the process in accordance with the present invention.

Figure 3:
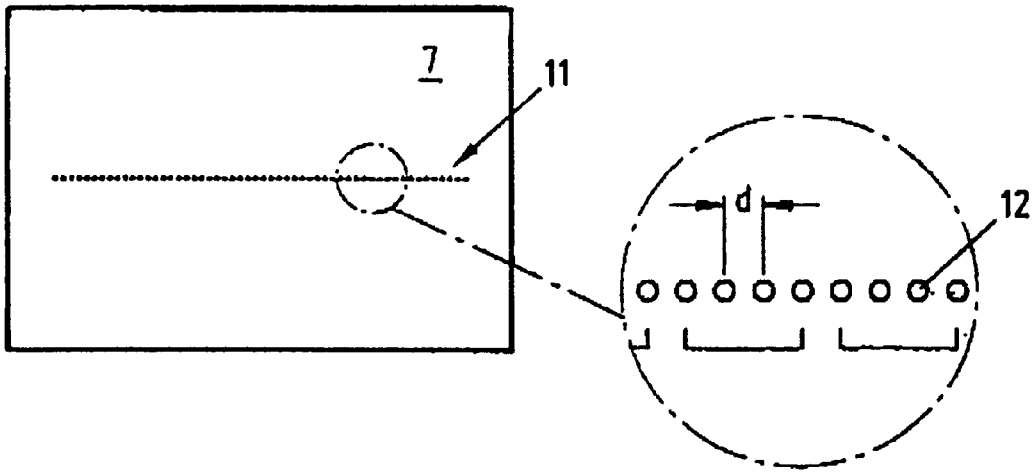
FIG. 3 shows a view of a printing head of one embodiment of a device in accordance with the present invention for producing a printing tool.

One view of the printing head 7 in accordance with one embodiment is shown from the direction of the rotogravure roller 6 in FIG. 3. It can be recognized that the printing head 7 has a row 11 of nozzles 12 which are shown more clearly in the enlarged cutout in FIG. 3. Via these nozzles 12, the printing head 7 sprays liquid wax onto the surface of the rotogravure roller 6 where it solidifies very quickly by cooling as a result of heat conduction. The distances d between the individual nozzles 12 are thus larger than would actually be possible at the maximally guaranteed resolution.

The maximum attainable resolution of the embodiment of a device in accordance with the present invention is ensured by using a special process for controlling the nozzles in the printing process. In this process, the nozzles are functionally combined into groups of four nozzles (for example), as shown in FIG. 3. These nozzles are triggered at this point using the process illustrated in FIG. 4.

At time t=0, the overlap between the first group of nozzles and the workpiece is set, whereupon the workpiece is moved on the one hand over its entire length in the Y-direction relative to the printing head, and at the same time wax is sprayed from the nozzles. Then, the printing head at time t=1 is advanced in the direction of the X-axis far enough that another group of nozzles overlaps with the surface of the workpiece but only by a step to which the group width minus the distance of adjacent nozzles divided by the number of groups corresponds and not by a step which corresponds to the entire width of the group. This guarantees that during the second relative movement between the printing head and the workpiece, there is no overlap between the line which is now described by the second group and the line which was described previously at time t=0 by the first group so that the previous line and the new line complement one another with the maximum resolution. Then the printing head is advanced in turn by the group width minus one quarter of the distance of adjacent nozzles in the direction of the X-axis at time t=2 (in the embodiment having four groups). In turn, the relative movement between the printing head and workpiece takes place over the entire height of the workpiece in the direction of the Y-axis, by which in turn, adjacent lines of wax are printed onto the workpiece in maximum resolution.

As soon as the last group has been shifted in turn by one step width further in the direction of the X-axis after completion of the relative motion between the printing head and workpiece at time t=3, the wax mask is completed on the first group width on the left edge of the workpiece in maximum resolution. This means that for each revolution of the workpiece, it is not the complete mask which is applied to the workpiece in the area of the nozzles, but only a fraction of the mask, while the next fractions are then applied by the following groups.

Figure 4:
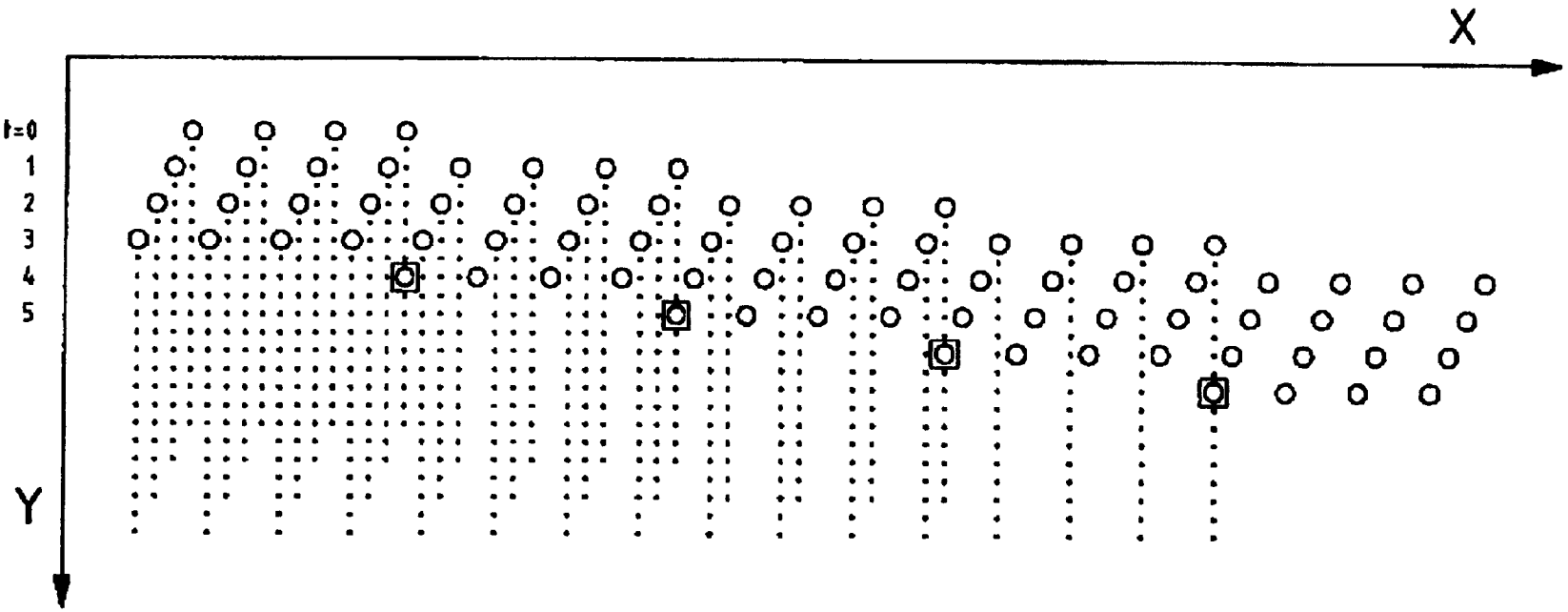
FIG. 4 shows an embodiment of a process in accordance with the present invention for producing a printing tool.

As can be seen from FIG. 4, it is advantageous to deactivate the last nozzle of the last group or to not include it at all, since this nozzle which is angularly edged in FIG. 4, covers the line which is described by the first nozzle of the first group otherwise on the same X-coordinate. Otherwise, this would lead to a nonuniform layer thickness and thus, nonuniform resolution of the wax layer. Alternative to the computation of the step width in the direction of the X-axis by the group width minus the distance of adjacent nozzles divided by the number of groups, the step width can also be fixed by the group width plus the distance of adjacent nozzles divided by the number of groups. In this case, the last group can also consist of the complete number of nozzles without overlaps occurring. In either case, the relative movement of the nozzles and the workpiece in a direction of the X-axis is a step width movement corresponding to a group width offset by a distance of adjacent nozzles divided by the number of the groups.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claimed is:

1. A process for producing a printing tool comprising the steps of:

providing a workpiece having a surface which is subjected to a chemical surface working;

forming a mask for sectional chemical passivation by spot spraying said surface of said workpiece, section-by-section, with a wax; and performing chemical surface working on areas of said surface of the workpiece left exposed by said mask so as to form a printing tool with a pattern set by said mask;

wherein said wax is sprayed onto said surface of said workpiece by a plurality of nozzles that are controlled with EDP support.

2. The process of claim 1, wherein said chemical surface working is an etching process.

3. The process of claim 2, wherein said printing tool is a printing form for at least one of rotogravure printing and relief printing.

4. The process of claim 1, wherein said printing tool is a mold and said chemical surface working is a galvanic coating process.

5. A process for producing a printing tool comprising the steps of:

providing a workpiece having a surface which is subjected to a chemical surface working; and spot spraying said surface of said workpiece, section-by-section, with a material which forms a mask for sectional chemical passivation;

wherein a wax is sprayed onto said surface of said workpiece by a plurality of nozzles that are controlled with EDP support as the material which forms said mask; and wherein said nozzles are arranged next to one another in a direction of an X-axis and are combined functionally into groups of at least one nozzle, said process further comprising the steps of:

moving at least one of said workpiece and said nozzles relative to one another in a direction of a Y-axis, chemical surface working said workpiece in the direction of the Y-axis; and moving at least one of said nozzles and said workpiece relative to one another in a direction of the X-axis to a new position with reference to the X-axis;

wherein relative movement of said nozzles and said workpiece in a direction of the X-axis is a step width movement corresponding to a group width offset by a distance of adjacent nozzles divided by the number of said groups.

6. The process of claim 5, wherein said relative movement of said nozzles and said workpiece in a direction of the X-axis is a step width movement corresponding to a group width minus a distance of adjacent nozzles divided by the number of said groups.

7. The process of claim 5, wherein said relative movement of said nozzles and said workpiece in a direction of the X-axis is a step width movement corresponding to a group width plus a distance of adjacent nozzles divided by the number of said groups.

8. The process of claim 5, wherein a group of nozzles positioned lastly in a direction towards the motion along the X-axis is formed from one nozzle less than the remaining groups.

* * * * *